US005972046A

United States Patent [19]

Hixson et al.

[11] Patent Number: 5,972,046

[45] Date of Patent: Oct. 26, 1999

[54] METHOD FOR DYEING CATIONIC DYEABLE NYLON WITH FIBER REACTIVE DYES WITHOUT HEAT SETTING

[75] Inventors: Robert Reginald Hixson, Rossville; David Ray Kelly, Fort Oglethorpe, both of Ga.

[73] Assignee: Custom Equipment Leasing, Inc., Rossville, Ga.

[21] Appl. No.: 09/120,812

[22] Filed: Jul. 22, 1998

[51] Int. Cl.[6] ..... D06P 3/10

[52] U.S. Cl. ..... 8/539; 8/543; 8/549

[58] Field of Search ..... 8/543–549, 539

[56] References Cited

U.S. PATENT DOCUMENTS 5,707,469 1/1998 Hixson et al. ..... 156/72

*Primary Examiner*—Margaret Einsmann

*Attorney, Agent, or Firm*—Chambliss, Bahner & Stophel, P.C.

[57] ABSTRACT

A method is provided for dyeing cationic dyeable nylon fibers with fiber reactive dyes. According to this method, an aqueous dyebath is provided containing one or more fiber reactive dyes. The dyebath has a pH of about 1.5 or below. The dyebath is heated to a temperature of at least about 160° F., and the cationic dyeable nylon fibers are immersed in the dyebath for a period of time sufficient for weak bonding to occur between the dye and the fibers. The nylon fibers are removed from the dyebath and immersed in an alkaline solution for a period of time sufficient for the dye to become covalently bonded to the fibers. The cationic dyeable nylon fibers are removed from the alkaline solution and dried.

16 Claims, No Drawings

METHOD FOR DYEING CATIONIC DYEABLE NYLON WITH FIBER REACTIVE DYES WITHOUT HEAT SETTING

FIELD OF THE INVENTION

This invention relates generally to the dyeing of cationic dyeable nylon with fiber reactive dyes.

BACKGROUND AND DESCRIPTION OF THE PRIOR ART

There is a need within the textile industry for pre-colored nylon yarns which can be combined with undyed nylon and then overdyed by a method which will color the undyed nylon without dyeing or staining the precolored nylon yarns. Such a precolored yarn may offer stylists an opportunity to achieve a wide variety of multicolored effects in carpeting and other textile applications which cannot be achieved in any other way. One way in which nylon producers have attempted to satisfy the need for precolored styling yarns is by a use of cationic dyeable nylon, one of two types of nylon, when considered from the standpoint of electrostatic charge.

Acid dyeable nylon is a synthetic long-chain polymer that includes a number of positively charged amine or amide groups that are receptive to negatively charged dyes. Among these anionic dyes are several categories, but the most important for use in dyeing acid dyeable nylon are the acid dyes and the premetallized acid dyes. Depending on the number of amine or amide groups in the acid dyeable nylon, it may be characterized as deep-dye, medium-dye or light-dye. Under certain conditions of temperature and pH level, acid dyes will form ionic bonds with the amine and/or amide groups in the nylon.

Cationic dyeable nylon is a type of nylon that has been treated by its manufacturer to impose an overall negative charge on the nylon. This makes it difficult for cationic dyeable nylon to accept negatively charged acid dyes at certain pH levels. Since most common liquids which may be spilled on carpet are negatively charged, cationic dyeable nylon therefore is naturally and inherently stain resistant.

Cationic dyeable nylon was initially developed to be dyeable with positively charged cationic dyes. When combined with acid dyeable nylon, unique multicolor effects may be created when acid dyes and cationic dyes are used in the same dyebath. However, cationic dyes do not generally offer the versatility and colorfastness properties of acid dyes, and so the use of cationic dyes to dye cationic dyeable nylon for styling purposes is somewhat limited.

Another way in which nylon producers have attempted to satisfy the need for precolored styling nylon has been by the use of color-sealed or solution-dyed nylon. These nylons are pigment colored during the extrusion process. This locks the color into the nylon structure, so it will not bleed during the overdye process. If solution-dyed nylon is cationic dyeable, it will not be stained by the acid dyes used to color the nylon in subsequent dyeing operations. However, solution-dyed nylon is only available in a limited number of pre-selected colors, which limits its usefulness as a styling tool.

In recent years, processes have been developed for dyeing cationic dyeable nylon with acid dyes and premetallized acid dyes. Such processes are described in U.S. Pat. No. 5,085,667 and U.S. Pat. No. 5,466,527 of Jenkins, U.S. Pat. No. 5,199,958 of Jenkins et al. and U.S. Pat. No. 5,626,632 of Boyes. These processes apparently involve the formation of ionic bonds between the acid and premetallized acid dyes and the fibers. Jenkins teaches the application of acid and premetallized acid dyes at pH levels within the range of about 2.0 to about 6.5 (4.0 to 6.5 in U.S. Pat. No. 5,199,958), and Boyes teaches the application of the same type of dyes at pH levels of 2.5 or below. However, while some of the shades produced by the methods of Jenkins and Boyes may sufficiently hold their color in continuous overdyeing, it is unlikely that shades produced by these methods will be substantive for extended periods of time when used to dye nylon in batch type overdye equipment such as a dyebeck, skein dye machine, package dyer, or paddle dyer.

U.S. Pat. No. 5,131,918 of Kelley teaches the application of a specific type of fiber reactive dyes to regular acid dyeable nylon that has been combined with cationic dyeable nylon. According to the Kelley method, the fiber reactive dyes are applied at a pH level within the range of about 2 to about 4, followed by steaming and washing, with the result that the acid dyeable nylon is dyed by the fiber reactive dyes while dyeing or staining of the cationic dyeable nylon is avoided.

Another method for dyeing acid dyeable nylon with vinyl sulfone type fiber reactive dyes was also developed by American Hoechst Corporation. According to this method, the vinyl sulfone dye was first pretreated with an alkali to convert the ester into the vinyl group, and then it was applied to acid dyeable nylon under moderate acid conditions. After washing, the printed nylon was dipped into an alkali solution, dried and heatset. When the vinyl sulfone dyes undergo heat setting under alkaline conditions, they form a covalent bond with the amine or amide groups of the nylon.

U.S. Pat. No. 5,445,653 of Hixson et al. describes a method for dyeing cationic dyeable nylon by application of fiber reactive dyes at a pH level no higher than 1.5. The nylon is steamed and washed to remove residual fiber reactive dyes and is then treated with an alkaline solution and heatset. During the heatsetting operation, the fiber reactive dyes form covalent or electron sharing bonds with the amine and amide groups in the cationic dyeable nylon, rather than the weaker ionic bonds of the methods of Jenkins and Boyes. The Hixson method, unlike the methods of Jenkins and Boyes, may be utilized to produce shades on cationic dyeable nylon that will be substantive when used to overdye the cationic dyeable nylon in combination with acid dyeable nylon in batch type overdye equipment such as a dyebeck, skein dye machine, package dyer, or paddle dyer. The inherent stain resistance of the cationic dyeable nylon resists dyeing and staining by acid dyes in the subsequent overdye operations and the covalently bonded fiber reactive dyes are extremely colorfast in dyebaths or continuous dye operations under ordinary overdyeing conditions.

U.S. Pat. No. 5,484,455 of Kelley also describes a method for dyeing cationic dyeable nylon with fiber reactive dyes. According to this method, a specific type of previnylized fiber reactive dye is applied to the nylon at pH levels between 1.5 and 3 (for printing) or between 2.0 and 3.0 (for exhaust dyeing). The nylon is then steamed and washed and an alkaline solution is applied in an amount necessary to raise the pH to between 9.0 and 10.5. After the alkane solution is applied, the nylon is dried and heatset to permit the formation of covalent bonds between the nylon and the dye.

Although both the Hixson method and the Kelley method of U.S. Pat. No. 5,484,455 appear to allow multicolored styling effects to be readily achievable, both methods also require heatsetting of the nylon in order to effect covalent bond formation. This may be done by autoclaving or in continuous wet or dry heat setting equipment such as Superba or Suessen ranges. Whatever method is used, heat-setting is an expensive and time-consuming operation. It would be desirable, therefore, if a method could be developed for dyeing cationic dyeable nylon with dyes capable of obtaining a wide range of colors without requiring a heat-setting step. It would also be desirable if such a method could be provided that would produce colored nylon capable of maintaining high colorfastness in dyebaths or continuous dye operations at 212° F. It would also be desirable if such a method could be developed for dyeing cationic dyeable nylon in such fashion to resist dyeing and/or staining by acid dyes in subsequent overdye operations.

OBJECTS AND ADVANTAGES OF THE INVENTION

Accordingly, it is an object of the invention claimed herein to provide a method of dyeing cationic dyeable nylon whereby the nylon will have a high degree of wash and bleed fastness when the dyed fiber is subjected to a further high temperature aqueous dyebath. It is another object of the invention to provide such a method for dyeing cationic dyeable nylon with fiber reactive dyes without the necessity for a subsequent heat setting operation. It is yet another object of this invention to provide such a method that may be accomplished in a batch dye process.

Additional objects and advantages of this invention will become apparent from an examination of the following description.

EXPLANATION OF TECHNICAL TERMS

As used herein, nylon is a synthetic long-chain polymer, sometimes called a polyamide, that can be made into fiber, yarn, and other products.

As used herein, cationic dyeable nylon is nylon that is made with an acid that interferes with the positive charge on some of the amine and/or amide groups, and tends to make some of the amine and/or amide groups of the nylon negatively charged. These negatively-charged amine and/or amide groups of cationic-dyeable nylon, therefore, tend to attract positively-charged dyes and to repel negatively-charged dyes.

As used herein, fibers includes filaments and fibers of all lengths and diameters, and fibers that have been formed into yarns, woven into fabrics, tufted or fusion bonded into carpets or formed into nonwoven fabrics, such as needle-punch fabrics or spunbonded or meltblown webs.

As used herein, dyeing refers to the coloring of polymeric fibers by the application of a dye or colorant to the fibers.

As used herein, ionic bonding refers to the type of bond that is formed between acid dyes and the amine and/or amide groups of nylon, which bond may be characterized by the transfer of electrons between the atoms of the dye and those of the fiber.

As used herein, weak bonding refers to the type of bond that is formed or the type of attraction that may exist between fiber reactive dyes and cationic dyeable nylon when such dyes are applied to the nylon at pH levels below about 1.5 but prior to the application of an alkaline solution. Examples of weak bonding may include ionic bonds, hydrogen bonds and Van der Waals forces.

As used herein, covalent bond refers to the type of bond that is formed between fiber reactive dyes and cationic dyeable nylon when such dyes are applied to the nylon at pH levels below about 1.5 followed by application of an alkaline solution, and may include a type of bond between two atoms that share a pair of electrons.

As used herein, fiber reactive dyes are dyes that are characterized by the fact that they form a covalent bond between the fiber-reactive portion of the dye and various chemical groups in the fiber.

As used herein, overdyeing is a process by which a combination of a previously dyed yarn and an undyed yarn, which have been combined by tufting them into a carpet or otherwise, is subsequently dyed.

As used herein, an aqueous solution includes homogeneous mixtures, blends, suspensions and dispersions containing water.

As used herein, a self shade refers to a use of an individual dye alone, and not in combination with any other dye, to dye a fiber.

As used herein, heatsetting refers to a process by which a dye or dyes may be fixed onto fibers by application of heat greater than about 230° F. Such dyes have been heatset.

SUMMARY OF THE INVENTION

A method is disclosed for dyeing cationic dyeable nylon fibers. According to this method, an aqueous dyebath containing one or more fiber reactive dyes is provided, said dyebath having a pH of about 1.5 or below. The dyebath is heated to a temperature of at least about 160° F., and the cationic dyeable nylon fibers are immersed in the dyebath for a period of time sufficient for weak bonding to occur between the dye and the fibers. The cationic dyeable nylon fibers are subsequently removed from the dyebath and immersed in an alkaline solution for a period of time sufficient for the dye to become covalently bonded to the fibers. The cationic dyeable nylon fibers are then removed from the alkaline solution and dried.

In order to facilitate an understanding of the invention, the preferred embodiments of the invention are described in the following detailed description. It is not intended, however, that the invention be limited to the particular embodiments described herein. Various modifications and alternative embodiments such as would ordinarily occur to one skilled in the art to which the invention relates are also contemplated and included within the scope of the invention described and claimed herein.

DESCRIPTION OF THE PREFERRED EMBODIMENTS OF THE INVENTION

The invention may be practiced on cationic dyeable nylon fibers produced by most of the major nylon manufacturers, whether such fibers are produced in filament or staple form. Examples of cationic dyeable nylon fibers which may be used in a practice of this invention include, but are not limited to:

| Manufacturer | Type or Brand |
|---|---|
| Solutia | Type JBT |
| | Type BBT |
| DuPont | Type 854 |
| | Type 494 |
| | Type 744 |
| | Type 754 |
| | Type 543A |
| | "Lumina" Type H-554A |
| BASF | "Zefron" W1185 |

-continued

| Manufacturer | Type or Brand |
|---|---|
| Allied | Type 7L422<br>Type 591 |

According to the invention, cationic dyeable nylon fibers are immersed in an aqueous dyebath containing one or more fiber reactive dyes. Experimentation has revealed that such application of fiber reactive dyes to the fibers will be successful only when the fiber reactive dyes are applied at pH levels of about 1.5 and below. Preferably, the dyes will be applied at pH levels at or below about 1.0. Experimentation shows that color yield drops considerably as the pH is elevated above about 1.0 and is unacceptable if the pH is higher than about 1.5. Any strong acid may be used to reduce the pH level in the dyebath to the desired level, but sulfamic acid is preferred because of its safe handling properties.

Fiber reactive dyes have the unique feature of striking the nylon at a slow rate which allows for uniform dyeing. Similar tests with acid and premetalized acid dyes have shown them to exhaust very rapidly, which results in extremely unlevel (and hence unsatisfactory) dyeings. It is believed that when fiber reactive dyes are applied in an aqueous dyebath at a pH level of about 1.5 and below, and at a temperature of about 160° F. and above, the internal amide structure of the cationic dyeable nylon will be receptive to various types of weak bonding with the dye, such as hydrogen bonding, Van der Waals forces, and the like. Furthermore, it is believed that such weak bonding will occur with complete penetration into the nylon. Although good results may be obtained when the temperature of the dyebath is at least about 160° F., preferred results can be obtained when the dyebath is heated to a temperature of at least about 180° F. More preferably, the dyebath will be heated to a temperature above about 200° F. and most preferably to a boil. The dyebath may be heated to the desired temperature prior to immersion of the cationic dyeable fibers therein, or the cationic dyeable fibers may be placed in the aqueous dyebath and the bath heated to raise the temperature to the desired level. Preferably, the cationic dyeable fibers are placed in the dyebath and the dyebath is heated to the desired temperature at a rate of within the range of about 2° F./minute to about 4° F./minute, most preferably at about 3° F./minute. Preferably, the temperature of the dyebath is maintained at the desired level, with the fibers immersed therein, for a period of about 30 to about 60 minutes, most preferably for about 45 minutes.

Fiber reactive dyes with vinyl sulphone, monochlorotriazine and bifunctional chemical structures have been tested. It is felt that chemical structure is not a prime factor in the acceptability of a dyestuff for use in the practice of this invention. Ease and completeness of covalent bond formation and ease of removal of residual unreacted dye seems to be of paramount importance.

Testing the individual dyestuff in a self shade is the best way to determine suitability for use in accordance with a practice of the invention.

All fiber reactive dyes must be previnylized before use to improve their capability of formation of covalent bonds with cationic dyeable nylon. Dyes which are acceptable for use in the practice of the invention include (but are not limited to) the following:

All Shades (Light through Dark)
Fourtex Yellow 3GN
Fourtex Yellow 2GR 150%
Fourtex Red 3B
Fourtex Red 6BN 150%
Fourtex Scarlet HEA
Rite Reactive Navy BF-2G
Fourtex Navy GR Other dyes perform well enough to be used in light to medium shades but may stain too heavily in darker shades. Some tested dyes which perform very well on cationic dyeable nylon in a practice of the method of U.S. Pat. No. 5,445,653 are totally unacceptable in a practice of this invention. Some examples of dyes that are unacceptable for use in the invention are:

Remalan Yellow C-3G
Fourtex Orange RA
Remalan Blue CRB
Lanasol Black R

After dye application, the cationic dyeable nylon is removed from the dyebath or the dyebath is drained therefrom. It is also preferred that the cationic dyeable nylon fibers be rinsed to remove excess dyes and chemicals. Since the dyes are attached to the fibers by weak chemical bonding, this rinse should be mild. Accordingly, if rinsing is desired, a series of rinses at about 80° F. to about 100° F. will be sufficient to remove excess dyes and other chemicals from the dyebath.

The next step is to cause the formation of covalent bonds between the fiber reactive dyes and the cationic dyeable nylon. This is accomplished by immersing the cationic dyeable nylon fibers in the alkaline solution for a period of time sufficient for the dye to become covalently bonded to the fibers. If the dyebath has been drained from the cationic dyeable nylon, an alkaline solution may be prepared and a fresh bath set with this solution. A number of alkaline materials are available to effect the formation of covalent bonds between the fibers and the dyes, but the preferred alkali is trisodium phosphate (TSP) in an aqueous solution. Preferably, sufficient alkali is provided so that the alkaline solution has a pH level at least as high as about 9.0. Preferably, the cationic dyeable nylon fibers are immersed in the alkaline solution for at least about 15 minutes. It is not necessary to apply elevated temperature to this alkaline solution, but the bath may be heated if desired. If so, it is preferred that the alkaline solution bath be circulated through the fibers at a temperature of about 80° F. to about 100° F. After application of the alkaline solution, the fibers are removed from the solution and dried. Further heatsetting is not required.

Cationic dyeable nylon fibers dyed according to the invention may be evaluated by means of a 210° F. overdye test, which is a laboratory test that accurately predicts how a dyed yarn will perform during a subsequent overdyeing process. In the 210° F. overdye test, the dyed cationic dyeable nylon yarn is placed in a beaker with a skein of undyed acid dyeable nylon yarn. An anionic leveling agent is added and the pH is buffered at 6.0. The yarns are then heated to a boil for 40 minutes. After rinsing and drying, the dyed yarn is evaluated for dye transfer to the undyed nylon and for color loss. Cationic dyeable nylon fibers dyed according to the invention will stain the undyed nylon (to which dye from the dyed fibers has been transferred) at a level no greater than 4 on the AATCC Stain Scale and will exhibit a color change rating of no lower than 4 on the AATCC Gray Scale after being subjected to the 210° F. overdye test. The 210° F. overdye test shows that when cationic dyeable nylon fibers are dyed with selected fiber reactive dyes according to the invention, the resulting dyed fibers will exhibit colorfastness as good or better than that obtained by dyeing according to the process of Hixson's U.S. Pat. No. 5,445,653 and heatsetting in an autoclave at 280° F.

The invention is further illustrated by way of the following examples:

EXAMPLE 1

A 40 gram sample of Solutia Type JBT cationic dyeable nylon was placed in a 1000 cc beaker of water at 80° F. and mechanically agitated. The following chemicals were added:

1.0% Lanawet 916 (non-ionic wetting agent)
0.5% Foursperse 36 (solubilizer for fiber reactive dyes)
3.0% Sulfamic Acid The following dyes were weighed out and dissolved in hot water:

0.5% Fourtex Yellow 2GR 150%
0.3% Fourtex Red 6BN 150%
5.0% Rite Reactive Navy BF-2G These dyes were first previnylized by adding TSP to the dye solution until the pH level was stable at 9.7. The previnylized dyes were added to the beaker and sulfamic acid was added until a pH of 0.98 was obtained. Then the temperature of the dyebath was raised to 212° F. at a rate of 3° F./minute and maintained at this temperature for 45 minutes. The bath was dropped to remove the yarn from the dyebath and the yarn was rinsed with water until clear. A fresh bath was set at 80° F. with 20 G/L TSP and the yarn was immersed therein. The alkaline solution was circulated through the nylon fibers for 15 minutes. The yarn was removed and dried at 300° F.

EXAMPLE 2

A 20 gram sample of the yarn dyed in Example 1 was heatset by autoclave at 280° F.

Both the non-heatset (Example 1) and heat set (Example 2) yarns were tested in the 210° F. overdye test. Both the non-heatset (Example 1) and the heatset (Example 2) cationic dyeable nylon yarns passed the 210° F. overdye test, but the non-heatset yarn of Example 1 showed slightly less color loss and less dye transfer than the heatset yarn of Example 2.

EXAMPLE 3

The same Navy Blue dye formulation of Example 1 was used. All other conditions of Example 1 were followed, except that the pH level of the dyebath was varied as follows:

Sample A—pH=1.26
Sample B—pH=1.50
Sample C—pH=1.77
Sample D—pH=2.02
Sample E—pH=2.50
Sample F—pH=2.99

As the pH level of the dyebath was increased, significant color loss occurred. The shade remained a Navy Blue for samples A and B. At a dyebath pH of 1.77 (Sample C) the color loss was over 50% and the resulting shade was a medium green blue. Estimated color loss at a dyebath pH level of 2.99 (Sample F) was 90%.

EXAMPLE 4

The method of Example 1 was followed except that a self shade of 5.0 G/L Fourtex Yellow 3GN was applied. The resultant color was a heavy bright yellow. The shade performed very well in the 210° F. overdye test with minimal color change or stain on the undyed nylon.

EXAMPLE 5

The method of Example 1 was followed except a self shade of 5.0 G/L Fourtex Red 3B was applied. The resultant color was a heavy bluish red. The shade performed very well in the 210° F. overdye test with minimal color change or stain on the undyed nylon.

EXAMPLE 6

The method of Example 1 was followed except a self shade of 5.0% Remalan Blue CB 133% was applied. The resultant color was a clear reddish blue. The 210° F. overdye test showed significant color loss and a heavy stain on the undyed nylon.

EXAMPLE 7

The method of Example 1 was followed but the following self shade dyes were applied:

Sample A: 5.0 GIL Fourtex Red 6BN 150% (a fiber reactive dye)
Sample B: 5.0 G/L Nylanthrene Red B-2BSA (an acid dye)
Sample C: 5.0 G/L Irgalan Red BKWL 200% (an acid premetalized dye)

Each dye produced a heavy red shade. The sample dyed with the fiber reactive dye (Sample A) was uniform while the dyeings with the acid dye (Sample B) and the premetalized acid dye (Sample C) were blotchy and uneven. The 210° F. overdye test showed the fiber reactive dye to maintain its color while not staining the undyed nylon. The acid and acid premetalized dyes both washed down and stained the undyed nylon.

Although not limited thereto, the invention is suitable for use in dyeing cationic dyeable nylon fibers in any type of equipment wherein the fiber reactive dyes can be applied to the fibers at pH levels of about 1.5 and below, and at temperatures of about 160° F. and above. Such equipment should also have the capability of allowing the fibers to be washed after dye application and for an alkaline solution to be subsequently applied. Examples of suitable equipment include, but are not limited to, skein dye machines, keir-type package dye machines and stock dye machines. Obviously, the cationic dyeable nylon fibers will be provided in skein form for immersion in the dyebath in a skein dye machine. Similarly, they will be provided in package form for immersion in the dyebath in a package dye machine, and they will be provided in rawstock form for immersion in the dyebath in a stock dye machine.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A method for batch dyeing cationic dyeable nylon fibers in skein form, package form or rawstock form, which method comprises:

(a) providing an aqueous dyebath containing one or more fiber reactive dyes, said dyebath having a pH of about 1.5 or below;

(b) heating the dyebath to a temperature of at least about 160° F.;

(c) immersing cationic dyeable nylon fibers, in skein form, package form or rawstock form, in the dyebath for a period of time sufficient for weak bonding to occur;

(d) removing the cationic dyeable nylon fibers from the dyebath;

(e) providing an alkaline solution;

(f) immersing the cationic dyeable nylon fibers in the alkaline solution for a period of time sufficient for the dye to become covalently bonded to the fibers;

(g) removing the cationic dyeable nylon fibers from the alkaline solution;

(h) drying the cationic dyeable nylon fibers without autoclaving them.

2. The method of claim 1 which includes providing the dyebath having a pH no higher than about 1.0.

3. The method of claim 1 which includes heating the dyebath to a temperature of at least about 180° F.

4. The method of claim 1 which includes heating the dyebath to a temperature of at least about 210° F.

5. The method of claim 1 wherein the dyebath is heated at a rate of about 3° F./minute.

6. The method of claim 1 which includes providing the alkaline solution having a pH level at least as high as about 9.0.

7. The method of claim 1 wherein the cationic dyeable nylon fibers are provided in skein form and are immersed in the dyebath in a skein dye machine.

8. The method of claim 1 wherein the cationic dyeable nylon fibers are provided in package form and are immersed in the dyebath in a package dye machine.

9. The method of claim 1 wherein the cationic dyeable nylon fibers are provided in rawstock form and are immersed in the dyebath in a stock dye machine.

10. The method of claim 1 wherein the cationic dyeable nylon fibers are rinsed after being removed from the dyebath.

11. The method of claim 1 wherein the cationic dyeable nylon fibers are rinsed after being removed from the alkaline solution.

12. The method of claim 1 wherein the cationic dyeable nylon fibers are immersed in the dyebath for at least about 45 minutes.

13. The method of claim 12 wherein the temperature of the dyebath is maintained within the range of about 180° F. to about 210° F. while the cationic dyeable nylon fibers are immersed therein.

14. The method of claim 1 wherein the alkaline solution is provided at a temperature within the range of about 80° F. to about 100° F.

15. The method of claim 1 wherein the cationic dyeable nylon fibers are immersed in the alkaline solution for at least about 15 minutes.

16. The method of claim 15 wherein the temperature of the alkaline solution is maintained within the range of about 80° F. to about 100° F. while the cationic dyeable nylon fibers are immersed therein.

* * * * *